US005277324A

United States Patent [19]

Cash

[11] Patent Number: 5,277,324

[45] Date of Patent: Jan. 11, 1994

[54] FLUID ABSORBING BOTTLE COVER

[76] Inventor: Gary D. Cash, 1757 Magnolia Ave., Buena Vista, Va. 24416

[21] Appl. No.: 973,706

[22] Filed: Nov. 9, 1992

[51] Int. Cl.[5] ..... B65D 23/06

[52] U.S. Cl. ..... 215/100.5; 215/303; 215/275; 215/278; 220/256; 220/284; 220/711; 220/729; 220/320; 81/3.09; 81/3.4

[58] Field of Search ..... 215/100.5, 303, 295, 215/275, 278; 220/737, 903, 284, 256, 711, 729, 320; 81/3.09, 3.4

[56] References Cited

U.S. PATENT DOCUMENTS 4,702,129 10/1987 Allen ..... 81/3.09
4,704,924 11/1987 Echols ..... 81/3.4
4,726,264 2/1988 Bost ..... 81/3.09 X
4,760,763 8/1988 Trick et al. ..... 81/3.09
4,811,858 3/1989 Augur ..... 220/903 X
5,176,278 1/1993 Quarberg ..... 220/320 X

*Primary Examiner*—Allan N. Shoap
*Assistant Examiner*—Paul A. Schwarz
*Attorney, Agent, or Firm*—Leon Gilden

[57] ABSTRACT

A bottle cover arranged for securement about an upper portion of a bottle member in a complementary relationship, wherein the bottle cover includes a body cavity and is formed of a fluid absorbing sponge material having a head portion to receive the bottle cap therewithin, with the head portion having a cylindrical cavity, including a cylindrical resilient insert arranged coextensively about an interior wall of the head portion for enhanced engagement of the bottle cap to permit rotation of the bottle cap relative to the associated bottle, with the sponge body arranged to absorb fluid in an overflow from the associated bottle member.

3 Claims, 4 Drawing Sheets

FLUID ABSORBING BOTTLE COVER

BACKGROUND OF THE INVENTION

1. Field of the Invention

The field of invention relates to bottle cover structure, and more particularly pertains to a new and improved fluid absorbing bottle cover wherein the same is directed to the absorbing of fluid from a bottle member.

2. Description of the Prior Art

The opening of carbonated beverage bottles frequently results in the overflow of fluid therefrom due to the projection of the carbonated beverage fluid from the bottle structure. The instant invention is arranged to address and overcome deficiencies of the prior art by providing for a bottle cover having a complementary cavity relative to the associated bottle to provide for contiguous communication to an exterior surface of the bottle and absorb fluid projecting therefrom.

SUMMARY OF THE INVENTION

In view of the foregoing disadvantages inherent in the known types of bottle cover structure now present in the prior art, the present invention provides a fluid absorbing bottle cover wherein the same is formed of a fluid absorbing sponge material addressing the absorbing of fluid from a bottle member. As such, the general purpose of the present invention, which will be described subsequently in greater detail, is to provide a new and improved fluid absorbing bottle cover which has all the advantages of the prior art bottle cover structure and none of the disadvantages.

To attain this, the present invention provides a bottle cover arranged for securement about an upper portion of a bottle member in a complementary relationship, wherein the bottle cover includes a body cavity and is formed of a fluid absorbing sponge material having a head portion to receive the bottle cap therewithin, with the head portion having a cylindrical cavity, including a cylindrical resilient insert arranged coextensively about an interior wall of the head portion for enhanced engagement of the bottle cap to permit rotation of the bottle cap relative to the associated bottle, with the sponge body arranged to absorb fluid in an overflow from the associated bottle member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid absorbing bottle cover which has all the advantages of the prior art bottle cover structure and none of the disadvantages.

It is another object of the present invention to provide a new and improved fluid absorbing bottle cover which may be easily and efficiently manufactured and marketed.

It is a further object of the present invention to provide a new and improved fluid absorbing bottle cover which is of a durable and reliable construction.

An even further object of the present invention is to provide a new and improved fluid absorbing bottle cover which is susceptible of a low cost of manufacture with regard to both materials and labor, and which accordingly is then susceptible of low prices of sale to the consuming public, thereby making such fluid absorbing bottle covers economically available to the buying public.

Still yet another object of the present invention is to provide a new and improved fluid absorbing bottle cover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
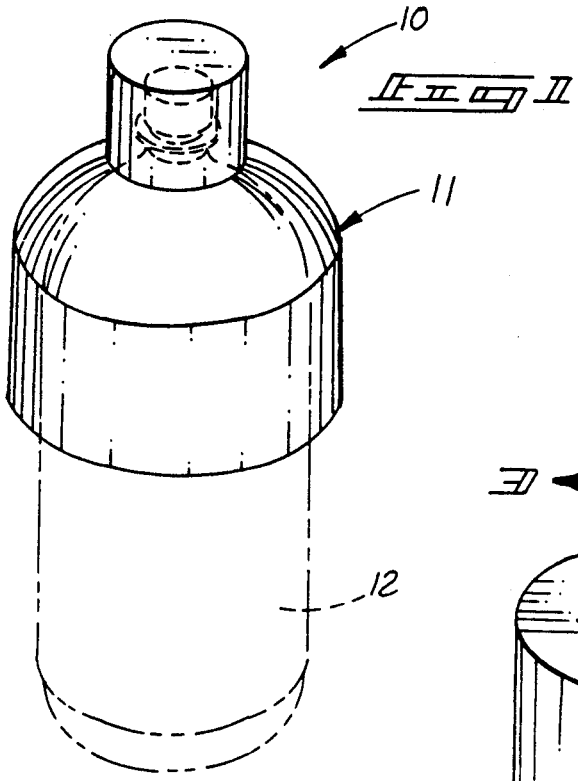
FIG. 1 is an isometric illustration of the invention.
Figure 2:
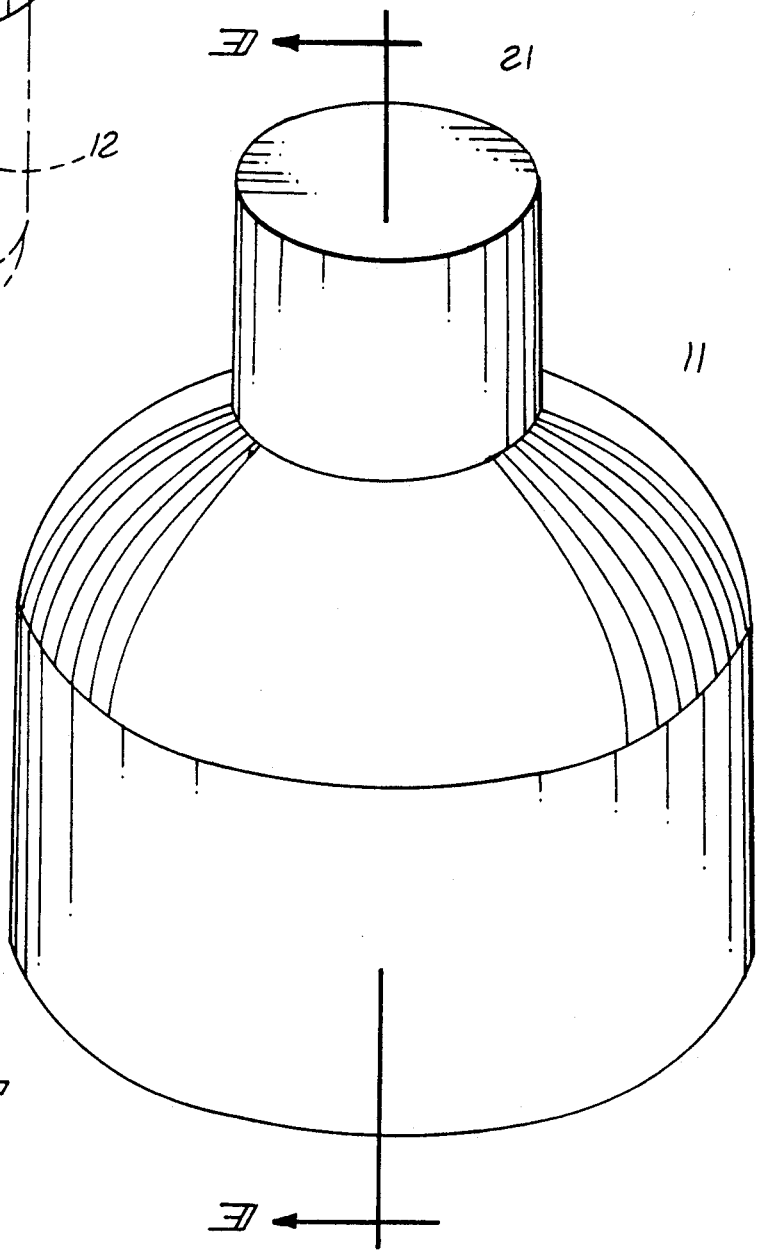
FIG. 2 is an enlarged isometric illustration of the cover structure.

With reference now to the drawings, and in particular to FIGS. 1 to 8 thereof, a new and improved fluid absorbing bottle cover embodying the principles and concepts of the present invention and generally designated by the reference numeral 10 will be described.

Figure 3:
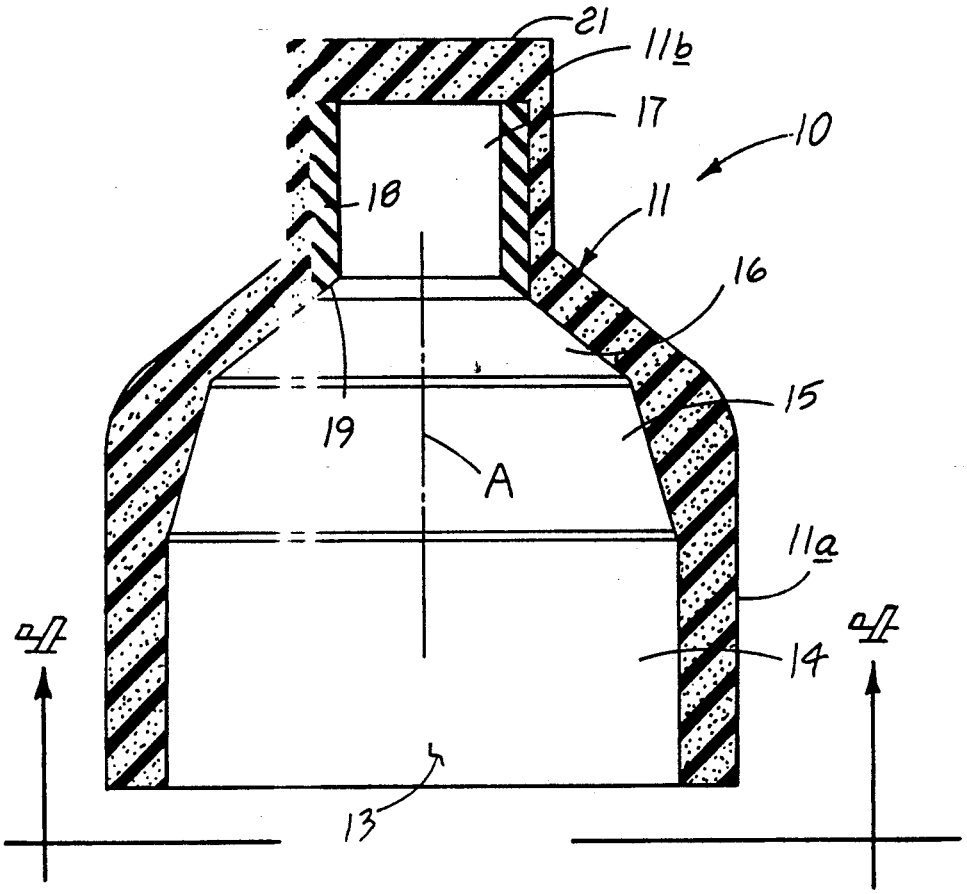
FIG. 3 is an orthographic view, taken along the lines 3—3 of FIG. 2 in the direction indicated by the arrows.
Figure 4:
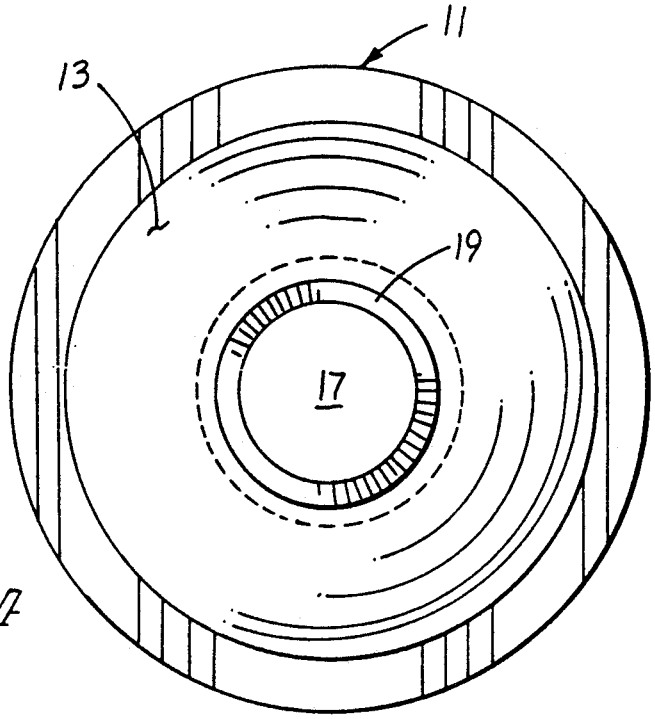
FIG. 4 is an orthographic view, taken along the lines 4—4 of FIG. 3 in the direction indicated by the arrows.

More specifically, the fluid absorbing bottle cover 10 of the instant invention is formed of a fluid absorbing sponge body 11 having a continuous side wall 11*a* mounting a cylinder head 11*b* to an upper distal end of the body symmetrically oriented about an axis "A", as indicated in FIG. 3. The body 11 includes a body cavity 13 complementarily receiving a bottle member 12 therewithin. The bottle cavity 13 includes a first cylindrical cavity 14 extending from a lowermost end of the body member, with a second conical portion 15 extending from the first cylindrical cavity portion 14. A third conical cavity portion 16 extends from the second conical cavities 14 and 15, with a fourth cylindrical cap receiving cavity portion 17 oriented within the cylindrical head portion 11*b*. All of the cavity portions 14–17 are symmetrically oriented about the axis "A". A cylindrical resilient insert 18 is coextensively and in contiguous fixed communication with an interior surface of the head portion 11*b*, having a beveled lower end 19 arranged to ease entry of a cap member of a bottom member 12, as indicated in FIG. 1, within the fourth cylindrical cap receiving cavity portion 17. A body top wall 21 forms an upper distal end of the sponge body 11.

Further, the silent insert 18 enhances ease of grasping and securing of a removable bottle cap that is typically threadedly mounted to an uppermost portion of a bottle member 12, while the sponge body 11 permits the absorbing of fluid that typically projects from the bottle member 12 upon removal of the cap therefrom.

Figure 5:
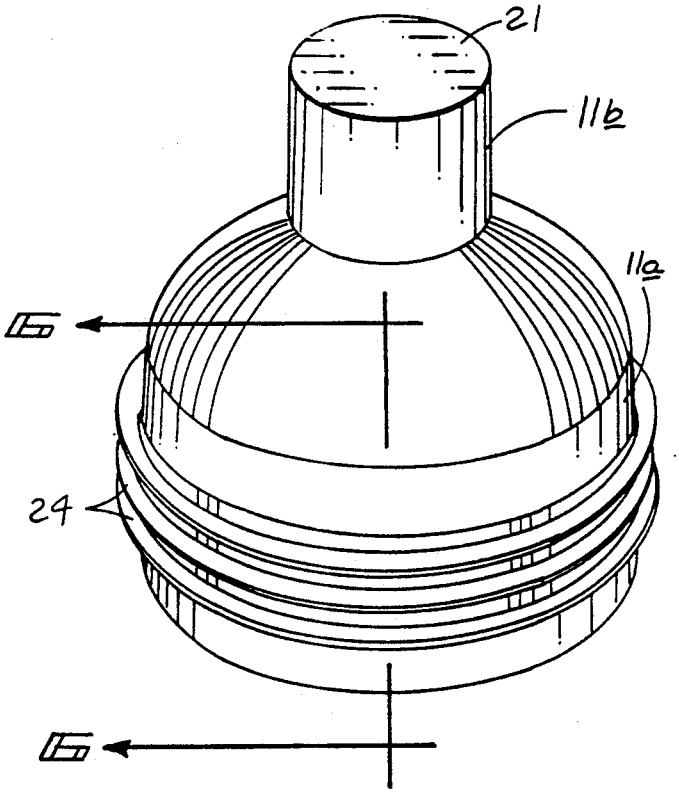
FIG. 5 is an isometric illustration of a modified bottle cover structure.
Figure 6:
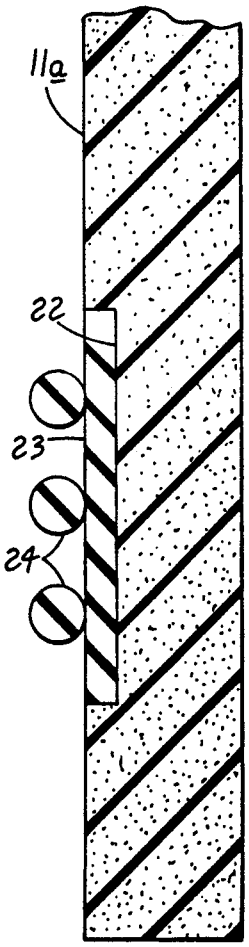
FIG. 6 is an orthographic view, taken along the lines 6—6 of FIG. 5 in the direction indicated by the arrows.

The FIGS. 5 and 6 indicates the use of an encircling cylindrical body recess 22 directed into an exterior surface of the side wall 11*a* adjacent the lowermost end of the body 11, having a cylindrical resilient band 23 complementarily and fixedly mounted within the body recess 22 to provide for enhancing grasping and securement of the bottle member when inserted within the body cavity 13. Further, a plurality of parallel stiffening ring members 24 are fixedly mounted to an in encircling relationship relative to the resilient band 23 to maintain geometric integrity of the body 11 in use.

Figure 7:
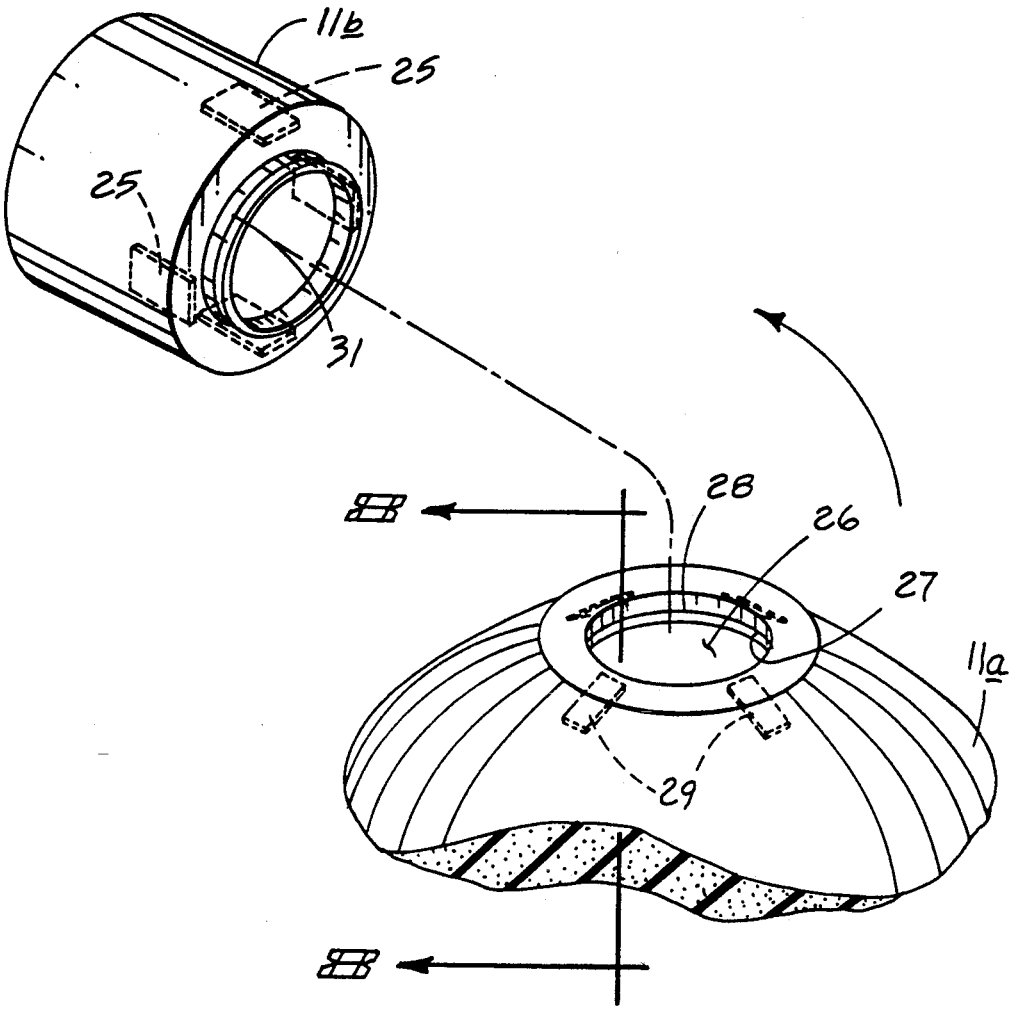
FIG. 7 is an isometric illustration of a further modified aspect of the invention.
Figure 8:
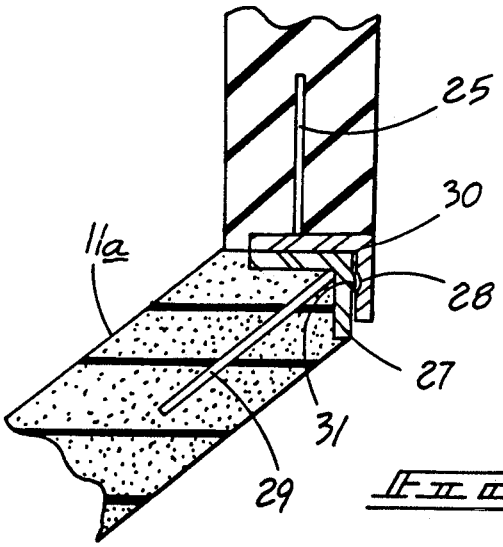
FIG. 8 is an orthographic view, taken along the lines 8—8 of FIG. 7 in the direction indicated by the arrows.

The FIGS. 7 and 8 indicates a modified aspect of the invention, having a body opening 26 coaxially oriented relative to the axis "A" for removably mounting the head portion 11*b* to the side wall 11*a*. A plurality of first rigid stiffening plates 25 are mounted to the head portion 11*b* positioned within the head portion 11*b* in an annular concentric relationship relative to the axis "A" to maintain the geometric integrity of the head portion during the grasping and securement thereof to the cap of the bottle member 12. An alignment plate 27 is fixedly mounted within the body opening 26 to the body 11, having an annular rib 28 projecting into the annular body opening 26 and received within an annular groove 31 of head portion flange 30 mounted to a lower distal end of the head portion 11*b*. In this manner, the rib 28 is rotatably mounted within the groove 31 to permit rotation of the head portion 11*b* in removal of a cap relative to the bottle member 12 while maintaining fastening of the head portion 11*b* to the side wall 11*a*. Further, a plurality of second rigid stiffening plates 29 are positioned within the side wall 11*a* in adjacency to the alignment plate 27 to minimize twisting of the body 11 upon rotation of the head portion 11*b* relative to the sponge body 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United State is as follows:

1. A fluid absorbing bottle cover arranged for receiving a bottle member therewithin, with the bottle member having a bottle body and a bottle spout, with the bottle spout including a bottle cap removably mounted relative to the bottle spout, and the bottle cover comprising, a sponge body, the sponge body including a continuous side wall and a cylindrical head portion extending from the continuous side wall, with the sponge body symmetrically oriented about a predetermined axis, and the sponge body having a body lower distal end, with a first cylindrical cavity portion directed into the sponge body from the lower distal end, and a second conical cavity portion directed from the first cylindrical cavity portion towards the cylindrical head portion, and a third conical cavity portion directed from the second conical cavity portion towards the cylindrical head portion, and the cylindrical head portion having a fourth cylindrical cavity receiving portion, and a cylindrical resilient insert fixedly mounted within the fourth cylindrical cavity receiving portion, and the resilient insert including a beveled lower end, and the resilient insert coextensive with the head portion within the fourth cylindrical cap cavity receiving portion, and the continuous side wall includes a side wall exterior surface, and the exterior surface having a cylindrical body recess continuously into the side wall, and concentrically relative to the axis, and the recess including a cylindrical resilient band complementarily and fixedly received within the body recess, and a plurality of stiffening ring members fixedly mounted to the resilient band, with the ring members concentrical relative to the axis.

2. A bottle cover as set forth in claim 1 including a plurality of first rigid stiffening plates concentrically oriented relative to the axis positioned within the head portion, and with the head portion having a head portion lowermost end, with the first rigid stiffening plates extending to the lowermost end, and the lowermost end including a head portion flange, with the flange having an annular skirt, and the annular skirt projecting below the lowermost end, and the annular skirt including an annular groove, and the side wall having a side wall opening at an uppermost end of the side wall, and the side wall opening concentric about the axis, and the side wall including an alignment plate continuously in surrounding relationship relative to the body opening, and the alignment plate including an annular rib, the annular rib arranged for rotative reception within the annular groove.

3. A bottle cover as set forth in claim 2 including a plurality of second rigid stiffening plates mounted within the continuous side wall in adjacency to the body opening, with the first rigid stiffening plates and the second rigid stiffening plates maintaining geometric integrity of the side wall and the head portion upon rotation of the head portion relative to the side wall within the body opening.

* * * * *